United States Patent [19]

Wilcox

[11] Patent Number: 4,987,708

[45] Date of Patent: Jan. 29, 1991

[54] SEISMIC ANCHOR

[75] Inventor: Jeffrey S. Wilcox, Grand Rapids, Mich.

[73] Assignee: Herman Miller, Inc., Zeeland, Mich.

[21] Appl. No.: 410,257

[22] Filed: Sep. 21, 1989

[51] Int. Cl.[5] ..... E04B 1/00; E04B 1/98

[52] U.S. Cl. ..... 52/126.6; 52/239; 52/241

[58] Field of Search ..... 52/126.6, 167, 239, 52/241, 274, 293

[56] References Cited

U.S. PATENT DOCUMENTS

| | | | |
|---|---|---|---|
| 452,527 | 5/1891 | McElroy . | |
| 1,155,376 | 10/1915 | Sherer . | |
| 1,375,043 | 4/1921 | Finlayson | 52/126.6 |
| 1,496,206 | 6/1924 | Burlin . | |
| 3,194,362 | 7/1965 | Wargo | 52/239 X |
| 3,811,237 | 5/1974 | Bettinger | 52/126.6 |
| 3,899,857 | 8/1975 | Mochizuki | 52/126.6 |
| 4,065,218 | 12/1977 | Biggane | 403/71 |
| 4,458,872 | 7/1984 | couch | 248/497 |
| 4,490,864 | 1/1985 | Wicker, Jr. | 5/9 R |
| 4,516,619 | 5/1985 | Hasbrouck | 52/239 X |
| 4,558,544 | 12/1985 | Albrecht et al. | 52/126.6 |

FOREIGN PATENT DOCUMENTS 552110 4/1923 France .

*Primary Examiner*—Richard E. Chilcot, Jr.
*Assistant Examiner*—Deborah M. Ripley
*Attorney, Agent, or Firm*—Varnum, Riddering Schmidt & Howlett

[57] ABSTRACT

The invention is for an anchor for securely mounting an article of furniture to a support surface. The anchor comprises a shank having a head at one end thereof and abutment means longitudinally spaced away from the head, and a mechanical fastener that is movably secured to the shank between the head and the abutment means. The anchor further comprises means for attaching the article of furniture to the shank, said means being adapted to be mounted to the article of furniture and having an opening received over the head of the shank. The anchor also comprises means positioned between the article attaching means and the head of the shank for selectively retaining the article attaching means on the shank. The mechanical fastener is adjusted to bear against the article attaching means to securely mount the article of furniture to the support surface.

14 Claims, 2 Drawing Sheets

SEISMIC ANCHOR

BACKGROUND OF THE INVENTION

1. Field of the Invention

This invention relates to an anchor for securely mounting an article of furniture or the like to a support surface and, more particularly, to an anchor for stabilizing modular office system wall panels against undesired movement resulting from seismic activity.

2. History of the Related Art

Modular office systems provide an excellent means for dividing otherwise large open areas into a plurality of smaller, more functional work spaces. A representative example of such a system is disclosed in U.S. Pat. No. 4,685,255 issued Aug. 11, 1987 to Kelley, et al. Typically, these systems comprise a plurality of panels joined together in an end-to-end or other angular relationship. Often times, work surfaces, storage cabinets and the like are cantilevered from the wall panels through the interengagement of hanger brackets and slotted hanger rails. Such systems are well known. An example is shown in U.S. Pat. No. 4,618,192 also to Kelley and issued Oct. 21, 1986.

The wall panels of the presently known systems are stabilized against undesired movement by being secured to each other and, at times, to a fixed surface such as a wall. While this arrangement is perfectly satisfactory for the vast majority of installations, occasionally it may be desirable to provide enhanced stabilization. For example, certain areas of this country, as well as the rest of the world, are subject to unexpected and potentially violent seismic or earthquake activity. These occurrences have been well documented in the press and elsewhere. Consequently, it would be desirable to have a way for securing articles of furniture or the like, and, more particularly, modular office system wall panels, to a floor surface to restrain the article against undesired movement that might result from unexpected structural or tectonic vibrations of unpredictable magnitude.

SUMMARY OF THE INVENTION

The invention is for an anchor for securely mounting an article of furniture to a support surface. The anchor comprises a shank having a head at one end thereof, an abutment means longitudinally spaced away from the head, and a mechanical fastener movably secured to the shank intermediate the head and the abutment means. The anchor further comprises means for attaching the article of furniture to the shank, said means being adapted to be mounted to the article of furniture and having an opening received over the head of the shank, and means positioned between the article attaching means and the head of the shank for selectively retaining the article attaching means on the shank. The mechanical fastener can be adjusted to bear against the article attaching means to securely mount the article to the support surface.

In a preferred embodiment, the means for attaching the article of furniture to the shank comprises a substantially U-shaped bracket having a pair of legs extending from a web, wherein a portion of the web defines an opening adapted to receive the shank. In the preferred embodiment, each leg of the U-shaped bracket has a portion defining a slot, each slot being adapted to receive means for securing the bracket to the article of furniture.

Also, in the preferred embodiment, the means for retaining the article attaching means on the shank includes a notch adapted to receive the shank and opposite edge portions that are formed with flanges that are adapted to straddle opposite edge portions of the web of the U-shaped bracket.

In the preferred embodiment, the abutment means is fixedly secured to the shank.

BRIEF DESCRIPTION OF THE DRAWINGS

The invention will now be described with reference to the drawings in which.

DETAILED DESCRIPTION OF THE PREFERRED EMBODIMENT

Figure 1:
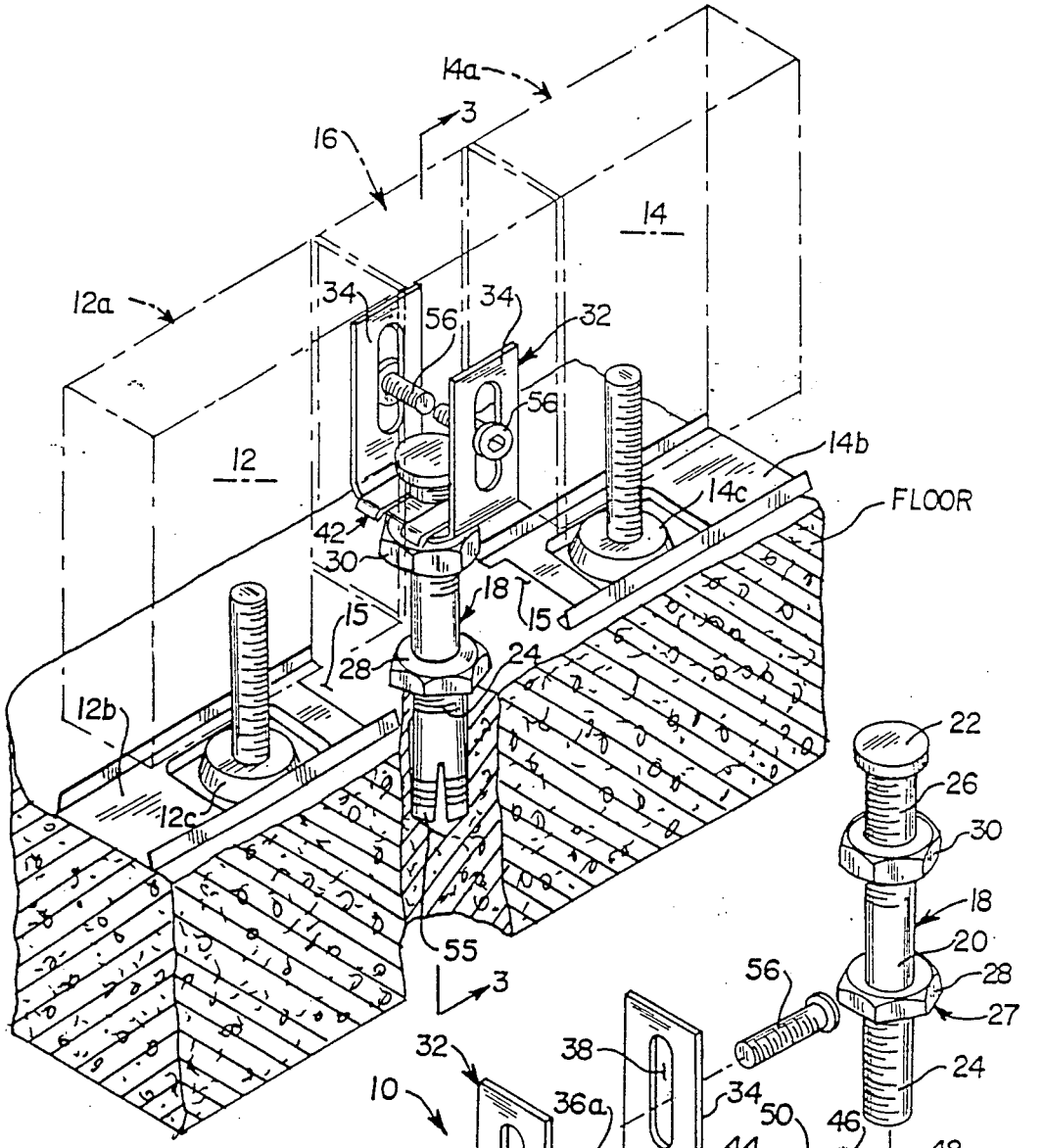
FIG. 1 is a fragmentary perspective view of modular office system wall panels in conjunction with a seismic anchor according to the invention.
Figure 3:
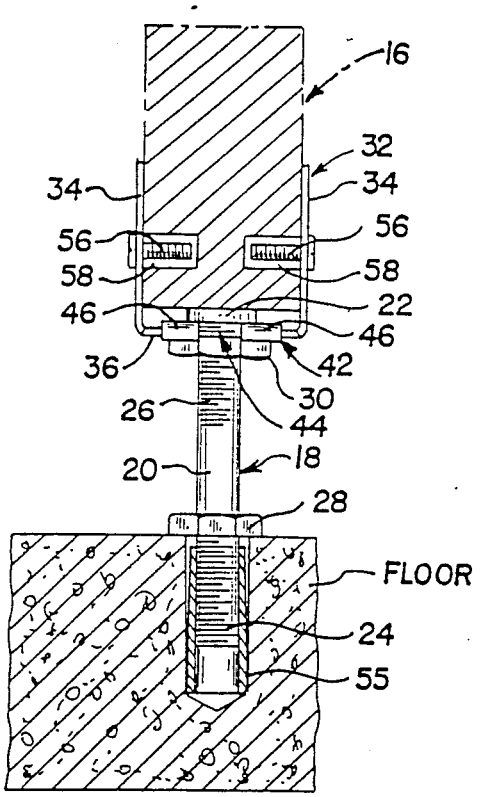
FIG. 3 is a sectional view taken along lines 3—3 of FIG. 1.

Turning now to the drawings, a seismic anchor is identified generally by the reference numeral 10. FIGS. 1 and 3 show the seismic anchor 10 in conjunction with a pair of wall panels 12 and 14 of the type typically utilized in a modular office system installation. The wall panels 12 and 14 are identical and are shown as being interconnected by a draw block 16 (shown in phantom line), the various designs of which are well known in the industry. A representative example of a draw block is disclosed in U.S. Pat. No. 3,430,097 issued Mar. 4, 1969 to R. L. Propst, et al. and entitled Panel Joint, which patent is herein incorporated by reference.

Associated with each panel 12 and 14 are, respectively, a wall portion 12*a*, 14*a* (shown in phantom line), a tray 12*b*, 14*b*, and a leveling glide 12*c*, 14*c*. It will be understood that the wall panels 12, 14 and their associated components form no part of the invention in its broader aspects and are described only for purposes of illustrating the use of the seismic anchor 10.

Figure 2:
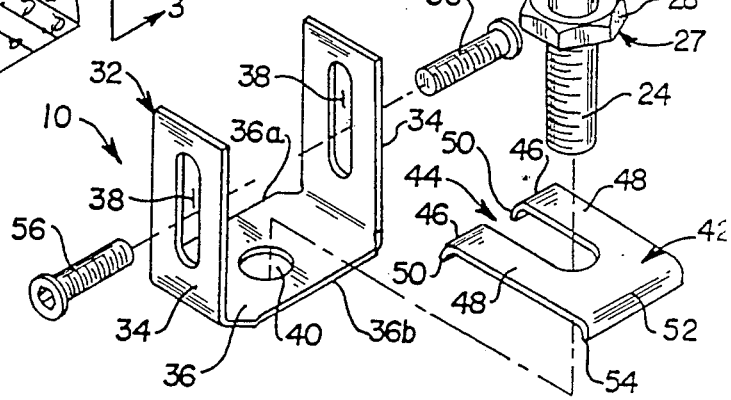
FIG. 2 is an exploded perspective view of the seismic anchor of FIG. 1 and showing an embodiment in which an abutment means is fixedly secured to a shank of a bolt.

The particular features of the seismic anchor 10 are shown most clearly in FIG. 2. In general, the seismic anchor 10 comprises means for securing the seismic anchor to a support surface, means for attaching an article of furniture or the like to the seismic anchor, and means for selectively retaining the furniture attaching means on the seismic anchor securing means.

Figure 4:
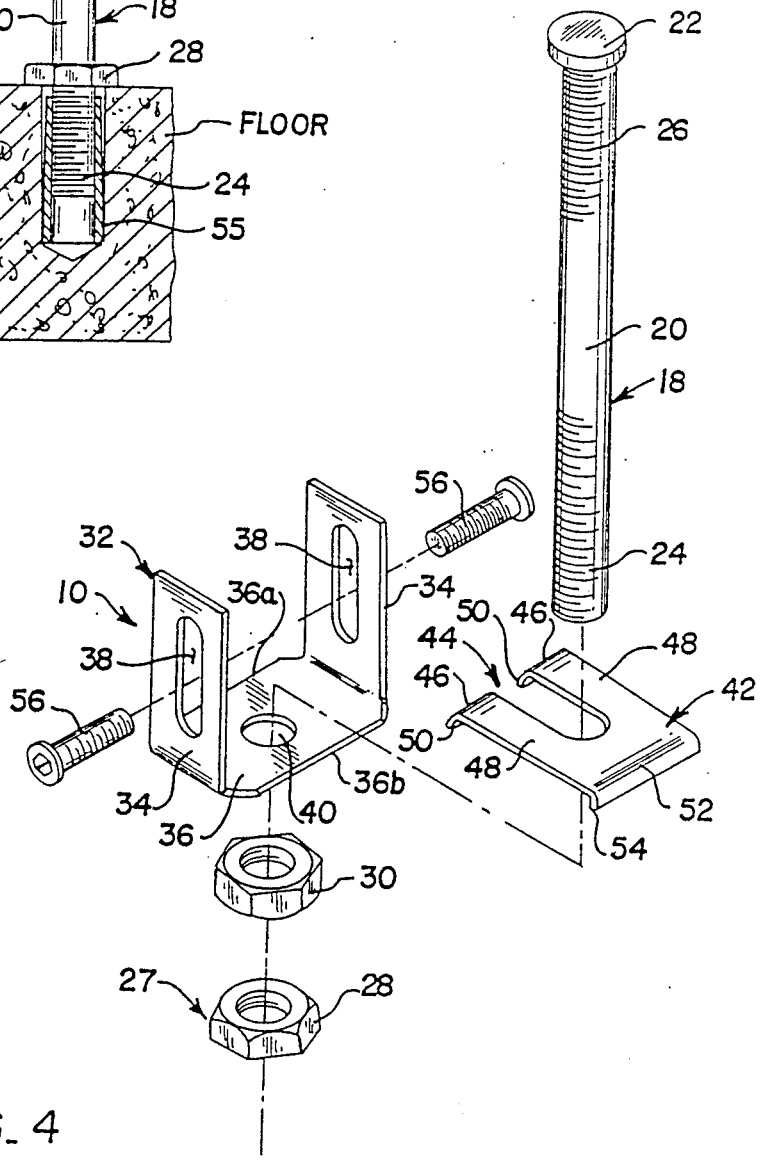
FIG. 4 is an exploded perspective view of the seismic anchor and similar to FIG. 2 but showing an embodiment in which the abutment means is threadably engaged with the shank of the bolt.

The means for securing the seismic anchor 10 to a support surface is shown in the form of a bolt 18 having a shank 20, a head 22 at one end of the shank 20, and first and second threaded sections, respectively designated 24 and 26, formed on the shank 20. The first threaded section 24 is formed at the distal end of the bolt 18 (the end of the bolt opposite the end having the head). The second threaded section 26 is formed adjacent to the head 22. The bolt 18 further includes abutment means 27 shown in the form of a conventional mechanical fastener 28. The fastener 28 may be fixedly secured to the shank 20 adjacent the first threaded section 24 (FIG. 2) or, alternatively, may be threadably engaged with the first threaded section 24 (FIG. 4).

Associated with the second threaded section 26 is a mechanical fastener shown as a nut 30.

If the bolt 18 is provided with abutment means 27 in the form of the fixedly secured mechanical fastener 28, the bolt 18 is formed in a multi-step process. Beginning with smooth bar stock of appropriate dimensions, the fastener 28 is fixedly secured at a location longitudinally spaced away from one end of the bar stock, which end will become the distal end of the bolt 18, by a forming process commonly known as cold heading. The nut 30 is slipped onto the opposite end of the bar stock or shank 20 and the head 22 is formed by cold heading the opposite end of the shank, thereby capturing the nut 30 intermediate the head 22 and the abutment means 27. In the final step, the first and second threaded sections 24, 26 are formed by the thread forming process typically referred to as rolling.

The means for attaching an article of furniture or the like to the seismic anchor 10 is shown in the form of a square U-shaped panel bracket 32 having a pair of legs 34 extending normally from a web 36 in parallel spaced apart fashion. Each leg 34 is provided with an elongated slot 38. An opening 40 is formed centrally in the web 36, the opening 40 having a diameter slightly larger than the diameter of the head 22. The web also has opposite edges 36*a*, 36*b*.

The means for selectively retaining the furniture attaching means on the seismic anchor securing means is shown in the form of a retainer bracket 42. The retainer bracket 42 is substantially square with a U-shaped notch 44 formed therein. The width of the notch 44 is greater than the diameter of the bolt shank 20 but less than the diameter of the head 22. The notch 44 interrupts an edge 46 of the retainer bracket 42 thereby forming a pair of legs 48. The distal end of each leg 48 is provided with a downturned flange 50. An edge 52 of the retainer bracket 42 is opposite the edge 46 and is similarly formed with a downturned flange 54.

In assembly, the bolt 18 is fixedly secured to the supporting surface such as a floor (shown conceptually in FIGS. 1 and 3). If the supporting surface is a concrete floor, for example, the floor should be predrilled with a concrete cutting drill bit and fitted with an internally threaded anchor 55. The first threaded section 24 of the bolt 18 is threadably engaged with the anchor 55 and the bolt 18 is tightened down until the abutment means 27 bears firmly against the supporting surface.

The panel bracket 32 is positioned over the top of the bolt 18 such that the head 22 and the shank 20 are received by the opening 40 formed in the web 36 of the bracket 32. The retainer bracket 42 is assembled by registering the bolt shank 20 with the notch 44 in the bracket 42. The flanges 50, 54 respectively engage the opposite edges 36*a*, 36*b* of the web 36 such that the retainer bracket 42 straddles the web 36.

The panel bracket 32 is then secured to the panels 12 and 14 by way of the draw block 16. Typically, the tray 12*b* or 14*b* will be cut away (as indicated in FIG. 1 by the reference numeral 15) to allow for the retainer bracket 42. The panels 12, 14 and the draw block 16 are then positioned between the legs 34 of the panel bracket 32. The panels are secured to the bracket 32 with screws 56 that register with both the slots 38 formed in the legs 34 and appropriate threaded openings 58 in the draw block 16. FIG. 3 shows the draw block 16 in section and the threaded openings 58 that are formed therein. The panels can be leveled using the leveling glides 12*c*, 14*c*. The slots 38 in the panel bracket legs 34 allow for minor height adjustment of the seismic anchor 10 to accommodate slight variations in panel design and installation technique.

The nut 30 is tightened until it bears firmly against the underside of the web 36 of the panel bracket 32, thereby securely holding the panel bracket 32, the wall panels 12, 14, and the retainer bracket 42 against the bolt 18. Because the retainer bracket 42 straddles the web 36 of the panel bracket 32, lateral sliding movement of the panel bracket 32 is restrained.

Although the abutment means 27 has been described as comprising a mechanical fastener 28 that is either fixedly secured to the shank 18 adjacent the first threaded section 24 (FIG. 2) or threadably engaged with the first threaded section 24 (FIG. 4), the former configuration is the preferred embodiment. If, for example, during the mounting of the seismic anchor to a concrete floor, concrete dust resulting from having pre-drilled the concrete floor, as described hereinabove, should accumulate between the internal threads of the floor anchor 55, insertion of the bolt 18 into the floor anchor may be somewhat hampered. However, if the abutment means is in the form of the fixedly secured fastener, the resistance to insertion of the bolt created by the accumulated concrete dust may be readily overcome by applying a wrench or other appropriate hand tool to the fixed abutment means and tightening the bolt therewith until the abutment means bears firmly against the floor or supporting surface.

Similarly, tightening the fastener 30 to engage the underside of the panel bracket web 36 is facilitated by use of the fixed abutment means. As the fastener 30 is tightened against the panel bracket web, it tends to cause the bolt 18 to rotate in the opposite direction thereby loosening the engagement of the bolt with the floor. This tendency for rotation may be resisted by applying a wrench or other hand tool to the fixed abutment means and torquing the bolt in a direction opposite to that of the undesired rotation, while simultaneously tightening the fastener 30.

The abutment means 27 in the form of the fastener 28 threadably engaged with the first threaded section 24 may be successfully employed in circumstances where the bolt 18 can be adequately tightened by hand and where the fastener 30 can be satisfactorily engaged with the panel bracket 32 without loosening the engagement of the bolt with the supporting surface.

Thus there is provided a means for securing an article of furniture and, more particularly, a modular office system wall panel, to a floor to prevent undesired movement that might otherwise result from seismic activity.

Reasonable variations or modifications are possible within the spirit of the foregoing specification and drawings without departing from the scope of the invention which is defined in the accompanying claims.

The embodiments of the invention in which an exclusive property or privilege is claimed are defined as follows:

1. An anchor for securely mounting an article of furniture to a support surface comprising:

a shank having a head at one end thereof and abutment means longitudinally spaced away from the head;

a mechanical fastener movably secured to the shank intermediate the head and the abutment means;

means for attaching the article of furniture to the shank, said means being adapted to be mounted to the article of furniture and having an opening received over the head of the shank; and means positioned between the article attaching means and the head of the shank for selectively retaining the article attaching means on the shank;

whereby the mechanical fastener can be adjusted to bear against the article attaching means to securely mount the article of furniture to the support surface.

2. An anchor according to claim 1 wherein the means for attaching the article of furniture to the shank comprises a substantially U-shaped bracket.

3. An anchor according to claim 2 wherein the U-shaped bracket comprises a pair of legs extending from a web, and wherein a portion of the web defines the opening adapted to receive the shank.

4. An anchor according to claim 3 wherein the opening adapted to receive the shank has a diameter greater than the diameter of the head of the shank.

5. An anchor according to claim 4 wherein each leg has a portion defining a slot, each slot being adapted to receive means for securing the bracket to the article of furniture.

6. An anchor according to claim 3 wherein the means for retaining the article attaching means on the shank further includes a notch adapted to receive the shank.

7. An anchor according to claim 6 wherein the retaining means further includes opposite edge portions formed with flanges adapted to straddle opposite edge portions of the web of the bracket.

8. An anchor according to claim 1 wherein the abutment means is fixedly secured to the shank.

9. An anchor according to claim 1 wherein the abutment means is threadably engaged with the shank.

10. An anchor according to claim 1 wherein the shank is partially threaded and the mechanical fastener is a nut threaded onto the shank.

11. An anchor according to claim 10 wherein the shank has first and second threaded sections, the first threaded section being adjacent a distal end of the shank and the second threaded section being adjacent the head of the shank.

12. An anchor according to claim 11 wherein the mechanical fastener is threadably engaged with the second threaded section of the shank.

13. An anchor according to claim 11 wherein the abutment means is fixedly secured to the shank adjacent the first threaded section.

14. An anchor according to claim 11 wherein the abutment means is threadably engaged with the first threaded section.

* * * * *